US005970436A

United States Patent [19]

Berg et al.

[11] Patent Number: 5,970,436

[45] Date of Patent: Oct. 19, 1999

[54] EQUIPMENT UTILIZATION DETECTOR

[76] Inventors: Eric A. Berg, 5550 Old William Penn Hwy., Apartment A-8, Export, Pa. 15632; James Fillar, 528 Center New Texas Rd., Pittsburgh, Pa. 15239

[21] Appl. No.: 09/129,683

[22] Filed: Aug. 5, 1998

Related U.S. Application Data

[63] Continuation-in-part of application No. 08/725,727, Oct. 4, 1996, Pat. No. 5,797,107.

[51] Int. Cl.[6] ..... G04F 8/00

[52] U.S. Cl. ..... 702/177; 701/29; 701/30

[58] Field of Search ..... 702/177, 176, 702/191, 193; 340/425.5, 438, 439, 457.4; 368/5, 6; 701/29, 30–35

[56] References Cited

U.S. PATENT DOCUMENTS

| | | | |
|---|---|---|---|
| 3,846,781 | 11/1974 | Smith | 340/267 R |
| 4,078,668 | 3/1978 | Hohmann | 212/39 MS |
| 4,126,237 | 11/1978 | Downing et al. | 214/674 |
| 4,296,409 | 10/1981 | Whitaker et al. | 340/684 |
| 4,551,703 | 11/1985 | Bourauel et al. | 340/52 D |
| 4,627,011 | 12/1986 | Spencer et al. | 364/566 |
| 4,722,547 | 2/1988 | Kishi et al. | 280/707 |
| 4,739,482 | 4/1988 | Wrigge | 364/424 |
| 4,757,454 | 7/1988 | Hisatake et al. | 364/424 |
| 4,853,856 | 8/1989 | Hanway | 364/424.01 |
| 4,926,331 | 5/1990 | Windle et al. | 364/424.04 |
| 5,046,007 | 9/1991 | McCrery et al. | 364/424.04 |
| 5,219,413 | 6/1993 | Lineberger | 180/272 |
| 5,249,127 | 9/1993 | Komatsu | 364/424.04 |
| 5,250,761 | 10/1993 | Koyanagi | 177/141 |
| 5,322,033 | 6/1994 | Doan | 116/308 |
| 5,327,347 | 7/1994 | Hagenbuch | 364/424.07 |
| 5,365,436 | 11/1994 | Schaller et al. | 701/33 |
| 5,379,219 | 1/1995 | Ishibashi | 364/424.04 |
| 5,844,473 | 12/1998 | Kaman | 340/439 |

*Primary Examiner*—John Barlow
*Assistant Examiner*—Craig Steven Miller
*Attorney, Agent, or Firm*—Webb Ziesenheim Logsdon Orkin & Hanson, P.C.

[57] ABSTRACT

A utilization detector detects when equipment undergoes at least one of a sudden motion or a slowly changing motion. In response to detecting sudden or slowly changing motion of the equipment, the utilization detector causes a production hour meter to accumulate time over which such motion is occurring. In response to detecting an absence of sudden or slowly changing motion of the equipment, the utilization detector causes an idle hour meter to accumulate time over which motion is not occurring. The utilization detector includes an off delay timer for maintaining the production hour meter accumulating time for a predetermined interval after the utilization detector detects the termination of sudden or slowly changing motion. When the production hour meter is accumulating time, the idle hour meter is not accumulating time and vice versa.

20 Claims, 9 Drawing Sheets

EQUIPMENT UTILIZATION DETECTOR

CROSS REFERENCE TO RELATED APPLICATION

This application is a continuation-in-part of application Ser. No. 08/725,727, filed Oct. 4, 1996 now U.S. Pat. No. 5,797,107, entitled "Equipment Utilization Detector".

BACKGROUND OF THE INVENTION

1. Field of the Invention

This invention relates to material handling vehicles and, more specifically, to detectors for measuring the utilization of such vehicles.

2. Description of the Prior Art

Material handling vehicles, such as bulldozers, excavators, on-highway trucks, wheel loaders and forklifts, currently make use of an engine hour meter to determine the vehicle's utilization, age, value and maintenance schedules. The engine hour meter measures the number of hours the engine has been running and is used in material handling vehicles in much the same manner as an odometer is used in automobiles. The engine hour meter for material handling vehicles and the odometer for automobiles both provide a frame of reference from which to appraise the vehicle's age, value, utilization and maintenance intervals. The engine hour meter is usually triggered to begin timing by way of the engine oil pressure sensor or the engine's alternator.

Maintenance activities, such as oil changes, filter replacement and machine greasing, are usually scheduled according to the number of hours on the engine hour meter. The age of material handling vehicles as well as their components, such as transmissions, torque converters, final drives, tires, undercarriages and engines, are measured according to the vehicle's engine hours. Knowing the number of hours the engine has been running allows an owner to know which components should be replaced or rebuilt. The engine hour reading also provides the owner with a general idea of what the material handling vehicle is worth on the open market. Those machines with high engine hours are deemed to have less value than those with low engine hours.

Most manufacturers of material handling vehicles provide warranties which are based on a certain number of engine hours or a certain period of time, whichever comes first. It is important for owners of new material handling vehicles to monitor their engine hours closely so as to determine whether or not repairs are covered under warranty. The manufacturer is interested in knowing the engine hour reading should there be an early failure of a component since the engine hour reading will give an indication of the wear on the component at the time of failure.

Material handling vehicles are capital items which are generally expensive to purchase and operate. Equipment costs are monitored closely by equipment owners. When calculating equipment costs, the total cost of the equipment is referenced to the engine hour reading so as to arrive at a unit value of dollars per engine hour. Although knowing the total cost is important, it is meaningless unless it can be compared to a time interval, which in the material handling industry is the engine hour. An equipment's cost per engine hour is an industry standard of measure against which material handling vehicles of the same size, class and product family are compared.

Many earthmoving operations use engine hours to determine an equipment operator's productive use of the equipment. The difference between the scheduled hours of operation (the start and end of a shift) and the engine hours clocked on the equipment during the shift provides management with a number against which to judge how effectively the equipment is being utilized.

As indicated above, the role of engine hours in material handling vehicles is regarded as one of the fundamental standards of measurement by those engaged in material handling applications. A problem with using the engine hour meter is that it is limited to recording whether an engine is on or off. Thus, an engine hour meter measures the utilization of the engine, but does not measure the utilization of the material handling vehicle as a whole. The engine hour meter cannot distinguish between the time when a material handling vehicle is idling and the time when a material handling vehicle is in productive use. For those operations where the material handling vehicle sits and idles for a large portion of the time, the use of the engine hour meter to determine the material handling vehicle's utilization, age, value and maintenance schedules would be misleading and costly. Routine maintenance involving oil changes, greasing and filter changes is done unnecessarily on material handling vehicles which spend most of their time idling. Although the engine oil needs to be changed according to the engine hours, the changing of the oil in the transmission and final drives, the greasing of the various joints and the changing of various filters need not be done as often as the engine oil. However, since the only available measure of equipment usage is the engine hour meter, time and money are wasted on performing unnecessary routine maintenance.

Measuring the wear of components based on engine hours can be misleading if the material handling vehicle spends considerable time at rest with the engine idling. Material handling vehicles which spend most of their time idling would be expected to have longer life on their components versus those having less idle time. Should the owner decide to rebuild or replace his components before an anticipated failure based on engine hours, the owner would be replacing or rebuilding components before it was necessary and thereby increasing costs unnecessarily.

A concern that is often voiced by owners of material handling vehicles, as well as manufacturers of material handling vehicles, is that it is difficult to compare component life for material handling vehicles with identical engine hours. A mining truck may wear its tires out in 3,000 engine hours and another mining truck may wear its tires out in 7,000 engine hours. One of the primary factors affecting this difference is the equipment utilization. The truck that wore out its tires in 3,000 engine hours spent most of its time being utilized in productive work while the truck with 7,000 engine hours spent a large portion of its time resting with the engine idling. The engine hour meter is limited in its ability to estimate the wear of major components on material handling vehicles since it does not measure the use of the vehicle as a whole.

Since engine hours are based on the engine running and not on the use of the material handling vehicle, the hourly costs associated with operating the equipment can fluctuate dramatically based on whether or not the equipment spends large periods of time at rest with the engine idling. It is difficult to create and maintain budgets for material handling vehicles when the equipment cost attributed to an hour of engine use can fluctuate as in the case of the tires used in the above example.

The greater the use that owners of material handling vehicles can obtain from their equipment fleet, the greater will be their production in terms of material moved per hour and the lower will be their overall costs. If the material handling vehicle spends most of its time at rest with the engine idling, then its production is low and its costs are high. The high costs are due to fixed costs (loan payments, insurance payments and operator salaries), variable costs (fuel consumption, routine maintenance and repairs) and opportunity costs (the loss of revenues by not having the equipment fleet producing at its maximum potential). The engine hour meter is not able to indicate whether or not the equipment is being utilized versus sitting at rest with the engine idling.

When a used material handling vehicle is sold, the engine hour reading is one of the principal determinants of the equipment's value. For those operations where the material handling vehicle sat at rest with its engine idling for considerable periods of time, the seller would like the potential purchaser to be aware that although the engine hour reading may be high, the machine was not worked hard and spent most of its time idling. The engine hour meter does not allow the purchaser to distinguish between idle hours and "utilization" hours. Consequently, the seller is forced to sell the used material handling vehicle based on its engine hours which do not necessarily reflect the equipment's actual value.

The only way that a material handling vehicle can typically be put to productive use is through an operator. It is the operator who is ultimately responsible for using the equipment. The engine hour meter cannot monitor the operator's use of the equipment since it only monitors that the engine is running. Many operations use the engine hour meter to monitor their operators. At the end of each shift the operator turns in a sheet showing the hours he worked (start of shift to end of shift) and the hours that the engine was running (engine hours accumulated during shift). If the engine hours are unusually low when compared to the scheduled hours, the operator will be held accountable. The limitation of this method of monitoring operators is that an operator can take a long break and leave his equipment idling. This is especially true on night shifts where there may not be a shift foreman on duty and the unsupervised equipment operators could take extended breaks as long as the engines on their material handling vehicles are running. The engine hour meter cannot monitor the operator's productive interaction with the machine.

Manufacturers of material handling vehicles have made great strides in placing sensors on their products to monitor various aspects of their equipment, such as velocity, engine speed and engine temperature. However, to date, there have been no sensors placed on material handling vehicles to monitor that the operator is in fact utilizing the equipment. There have been several efforts by earthmoving equipment manufacturers and after-market manufacturers to place sensors on mining trucks and wheel loaders to measure and monitor their productivity in terms of payload weights and cycle times where production is defined by the weight or volume of material moved in a unit of time, such as tons per engine hour. Since the aim of these efforts is to monitor and measure production, such systems have remained primarily in the domain of earthmoving trucks and wheel loaders where it is possible to measure the weight of payloads. Other types of material handling vehicles such as excavators, bulldozers, draglines, pavers and forklifts, however, have been ignored since their productive capabilities in terms of weight or volume of material moved per unit of time are not amenable to monitoring by sensors. Concern over the amount and rate of production in terms of weight or volume of material moved per unit of time is limiting because only a small number of material handling vehicle families, primarily trucks and wheel loaders, can be measured in this fashion.

Operator incentive programs are often designed around production. For example, a truck operator may be paid a bonus for each additional truck load of material over twenty truck loads of material during his shift. The limitation to production-oriented incentive programs is that they are dependent on the physical geometry of the job layout, which is rarely consistent. Within a given day, week or month, the haul roads may change such that on one day the truck operator is running on a short haul road and therefore able to achieve "bonus loads", but on the next day the truck operator may be required to run on a long haul road and not be able to achieve "bonus loads". Because production in terms of weight, volume or truck loads of material moved per unit of time can fluctuate each day through no fault of the operator, such production oriented incentive programs are not an accurate reflection of an operator's performance. Additionally, such production incentive programs cannot be used for operators of forklifts, bulldozers or excavators since the productive capabilities of these material handling vehicles are difficult if not impossible to continuously measure. Consequently, incentive programs for equipment operators are a hotly debated subject since there is currently no standard of measure which can be applied to various types of material handling vehicles and which directly measures the equipment operator's productive interaction with the equipment.

When a material handling vehicle is being used for productive purposes, it exhibits some form of motion within a certain time interval. Examples of productive use of material handling vehicles are a mining truck carrying a load of material to a dump site, a bulldozer pushing a load of dirt, a forklift carrying a box in a warehouse and a mining truck waiting for the second load of material from a hydraulic shovel. Because productive activities are defined as occurring within a predetermined time interval, even a mining truck waiting for another load of material from a hydraulic shovel is still in productive use even though it is idling between loads. For example, if the hydraulic shovel places a bucket load of material onto the mining truck every forty seconds, then every forty seconds the mining truck will experience a "jolt" when the hydraulic shovel dumps the material from its bucket into the bed of the mining truck. In this example, the previously mentioned time interval would be forty seconds. If the truck experiences no motion for a period longer than forty seconds, however, then it is not being used productively for the total "motionless" period minus forty seconds. All productive activities are characterized by motion occurring within a certain time interval. Consequently, measuring the time that a material handling vehicle is in motion is a measurement of the time that a material handling vehicle is in a state of production. Making a distinction between production (weight or volume of material moved per unit of time) and the state of being in production (utilization of the material handling vehicle) adds an entirely new dimension to the measurement of the productive activities of a material handling vehicle and provides a base against which all material handling vehicles can be measured and compared.

The engine hour meter measures the time an engine is running. An hour of engine use is a combination of the time the equipment is at rest with the engine idling and the time the equipment is in productive use. Consequently, engine hours equal idling hours plus production hours. If the engine hours and the idling hours are known, the production hours can be calculated by subtracting the idling hours from the engine hours. Likewise, if the engine hours and the production hours are known, the idling hours can be calculated by subtracting the production hours from the engine hours. The key is to distinguish between when a material handling vehicle is at rest with the engine idling and when a material handling vehicle is in a state of production. The hours that a material handling vehicle spends in production and the hours that a material handling vehicle spends at rest with the engine idling comprise what is referred to herein as equipment utilization. Production hours are a measure of the material handling vehicle's productive utilization. Idling hours are a measure of the material handling vehicle's non-productive utilization where the material handling vehicle is being utilized but in a non-productive way.

It is, therefore, an object of the present invention to monitor the state of motion of material handling vehicles and to accumulate the time spent in a state of motion on a time accumulator, such as an hour meter and to accumulate the time spent at rest with the engine idling on another time accumulator, such as an hour meter.

It is an object of the present invention to make use of a motion detection apparatus that can distinguish between actual vehicle productive utilization and vehicle vibration caused by engine vibration. The motion detection system is designed in such a way that when attached to a material handling vehicle, the motion detection system can sense motion independently of any of the vehicle's moving parts or fluids, such as transmission, engine, final drives, tires, oil flow or fuel flow.

It is another object of the present invention to provide a utilization detector that is portable, self-contained and isolated from harsh material handling environments and that can easily be placed on any vehicle, new or old.

It is a further object of the present invention to provide a utilization detector that is usable on all material handling vehicles regardless of the family, class or model of vehicle.

Still further objects and advantages will become apparent to those of ordinary skill in the art upon reading and understanding the following detailed description of the preferred embodiment.

SUMMARY OF THE INVENTION

Accordingly, we have invented an equipment utilization detector which is attachable to equipment for determining the utilization of the equipment. The utilization detector includes a motion detector and a motion analysis circuit. The motion detector generates an output signal upon a change of its position relative to a plane. In response to the output signal from the motion detector, the motion analysis circuit generates a sudden motion output signal in response to a sudden motion detected by the motion detector and/or a slow motion output signal in response to a slow motion detected by the motion detector. The utilization detector also includes a time accumulator responsive to the slow motion output signal and/or the sudden motion output signal. The time accumulator records a production interval and/or an idling interval. The production interval corresponds to the duration that the motion analysis circuit generates the slow motion output signal and/or the sudden motion output signal, and the idling interval corresponds to the duration that the slow motion circuit withholds the slow motion output signal and the sudden motion output signal.

Preferably, the motion detector is a dual axis inclinometer that detects changes of the position of the utilization detector in a horizontal plane along an X and a Y axis.

The utilization detector can include an off delay timer connected between the motion analysis circuit and the time accumulator. The off delay timer supplies to the time accumulator an output signal which commences recording of the production interval in response to the generation of the sudden motion output signal and/or the slow motion output signal. The off delay timer causes the time accumulator to record the production interval for a predetermined duration after the termination of the sudden motion output signal and/or the slow motion output signal. In response to termination of the output signal by the off delay timer, the time accumulator terminates recording the production interval and commences recording the idling interval. Preferably, the predetermined duration is adjustable.

The utilization detector can also include an OR gate which receives the slow motion output signal and/or the sudden motion output signal and supplies an output signal to the off delay timer in response to receiving one or both of these signals. A signal conditioner can be utilized to receive the output signal from the motion detector, to remove electronic noise impressed on the output signal from the motion detector, and to supply an output signal to the motion analysis circuit.

DETAILED DESCRIPTION OF THE PREFERRED EMBODIMENT

Figure 1:
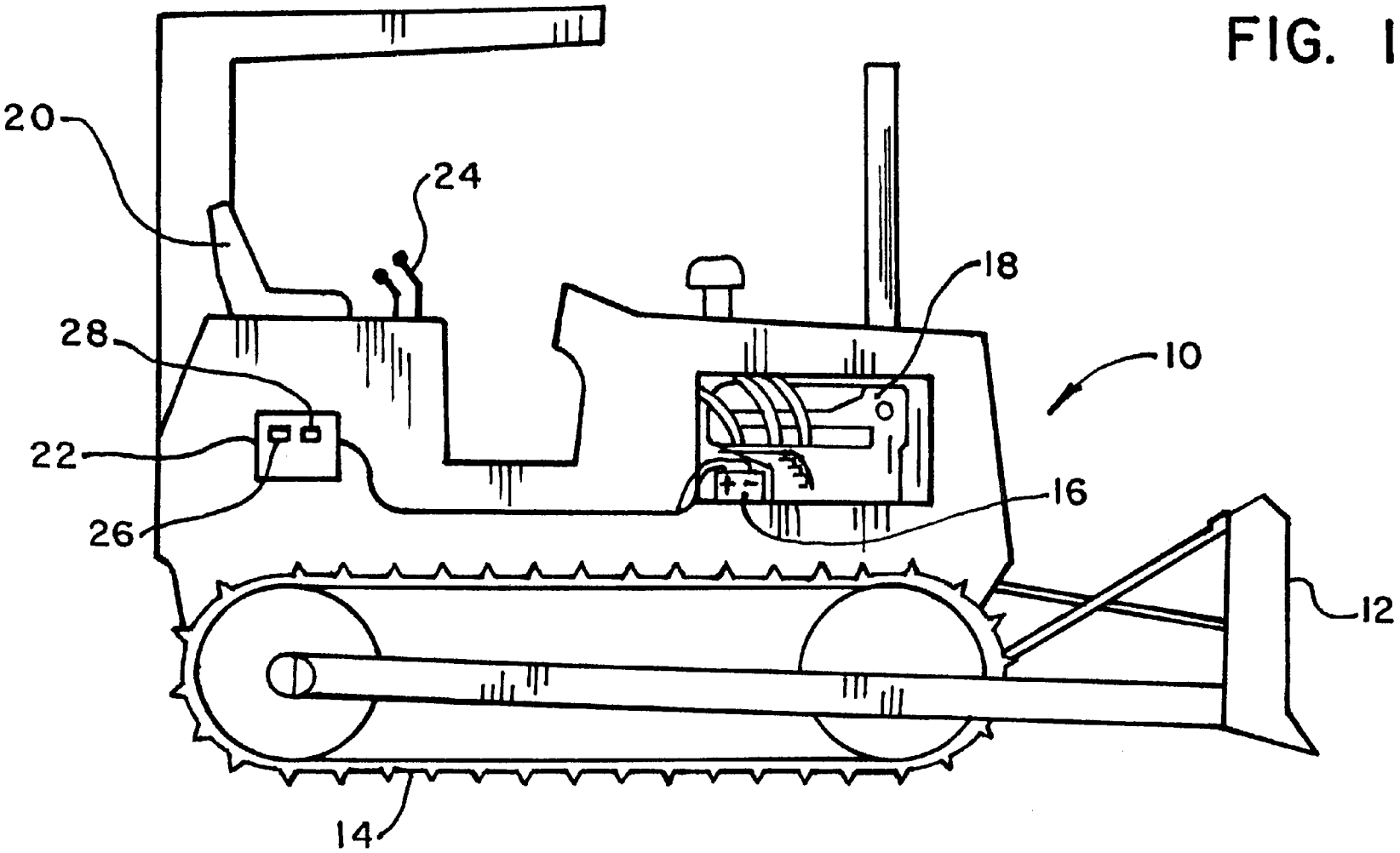
FIG. 1 is a side view of a bulldozer with a utilization detector in accordance with the present invention attached thereto.

With reference to FIG. 1, a material handling vehicle, such as a bulldozer 10, has a blade 12 positioned on its front for pushing dirt or other material. An operator sits in seat 20 and operates lever controls 24 that control the operation of the bulldozer 10. The bulldozer 10 is powered by an engine 18 and moves across the ground by a set of tracks 14. A power source, such as a battery 16, is utilized to start the engine 18 as well as to provide power to lights, control panel displays and other onboard electric devices. A utilization detector 22 in accordance with the present invention is attached to the bulldozer 10 and is powered by the battery 16. Other power sources, such as the alternator of the vehicle or a battery within the utilization detector 22, can also be used.

Figure 2:
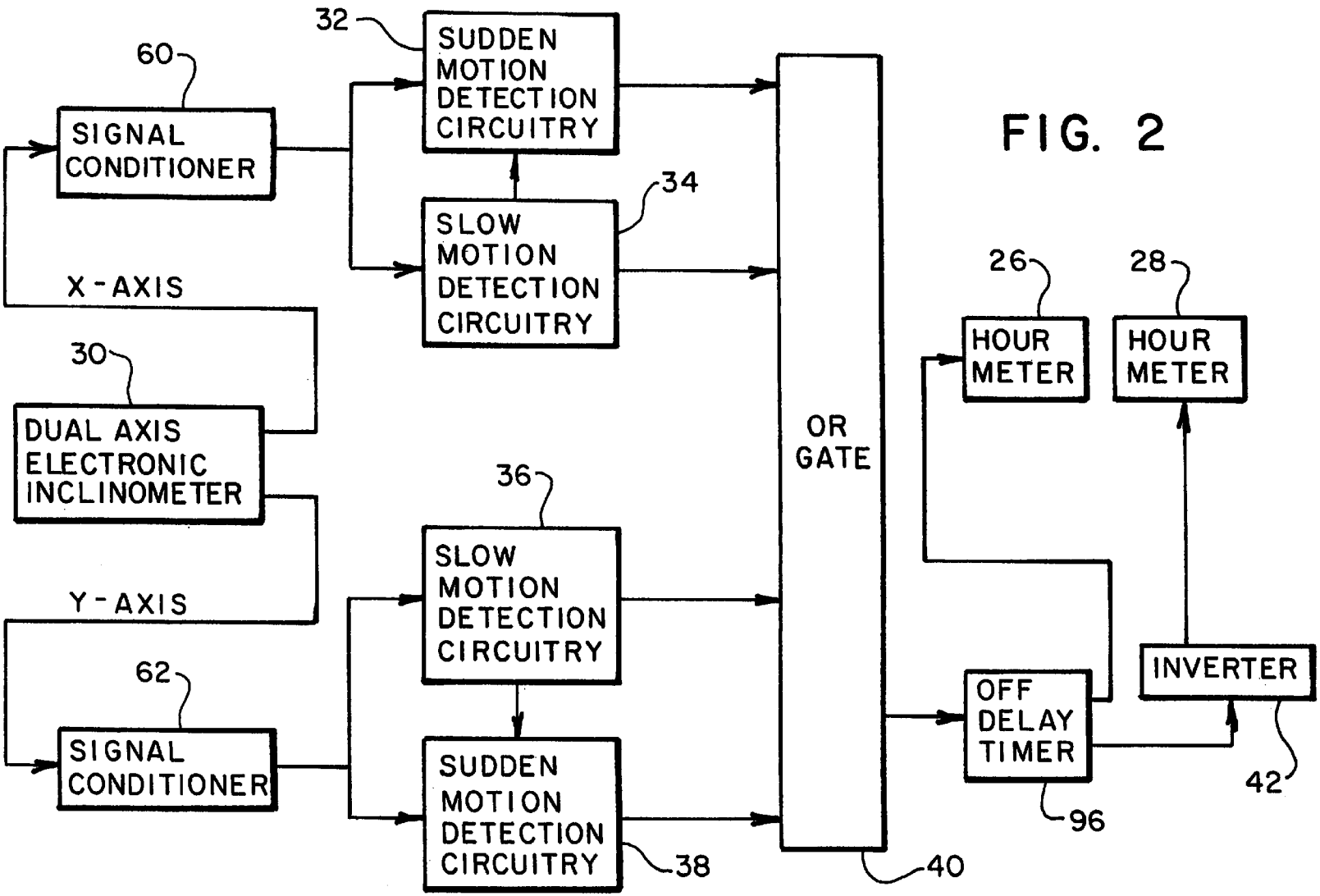
FIG. 2 is a block diagram of the utilization detector of FIG. 1.

With reference to FIG. 2, and with continuing reference to FIG. 1, the utilization detector 22 includes a time accumulator or hour meter 26, for displaying cumulative hours of productive utilization of the bulldozer 10 and/or a time accumulator or hour meter 28, for displaying the cumulative hours of non-productive utilization of the bulldozer 10. The utilization detector 22 also includes a motion detector or sensor, preferably a dual axis electronic inclinometer 30, which outputs an X-axis voltage signal and a Y-axis voltage signal. The magnitude of the X-axis voltage signal and the Y-axis voltage signal corresponds to the position and movement of the inclinometer 30 relative to a horizontal plane which extends therethrough. The inclinometer 30 resting on a horizontal plane will supply a voltage signal that is different from the voltage signal supplied if resting on an inclined plane. Thus, the inclinometer 30 supplies a voltage signal regardless of whether the inclinometer 30 is experiencing movement. If there is movement, however, the voltage signal will include voltage signals, e.g., voltage spikes, having an amplitude and duration that correspond to the extent of the movement.

The X-axis voltage signal output by the inclinometer 30 passes through a signal conditioner 60 to an X-axis sudden motion detection circuitry 32 and an X-axis slow motion detection circuitry 34. Similarly, the Y-axis voltage signal output by the inclinometer 30 passes through a signal conditioner 62 to a Y-axis slow motion detection circuitry 36 and a Y-axis sudden motion detection circuitry 38. The sudden motion detection circuitry 32, 38 detect motion that occurs when the material handling vehicle experiences a sudden movement or jolt, such as a bump, dip or acceleration force. In response to such sudden motion, one or both axes of the inclinometer 30 output a quickly changing voltage signal, i.e., a voltage spike, having an amplitude and duration corresponding to the sudden movement, and the sudden motion detection circuitry 32, 38 are each configured to detect this voltage spike. The slow motion detection circuitry 34, 36 detect motion that occurs when the material handling vehicle experiences gradual movement, such as when the vehicle is traveling or rotating slowly. In response to such slow motion, one or both axes of the inclinometer 30 output a gradually changing voltage signal that corresponds to the slow motion of the vehicle. The slow motion detection circuitry 34, 36 are each configured to detect the gradually changing voltage signal received from the signal conditions 60, 62, respectively.

In response to the inclinometer 30 detecting motion of a sufficient extent (to be discussed in greater detail hereinafter), one or more of motion detection circuitry 32, 34, 36, 38 supply a high voltage signal to an OR gate 40. In response to the supplied high voltage signal, the OR gate 40 supplies a high voltage signal to an off delay timer 96. In response to receiving the high voltage signal from the OR gate 40, the off delay timer 96 supplies a high voltage signal to the hour meter 26 and an inverter 42. In response to receiving the high voltage signal from the off delay timer 96, the hour meter 26 commences accumulating time and an inverter 42 converts the high voltage signal to a low voltage signal which is supplied to the hour meter 28. In response to receiving the low voltage signal from the inverter 42, the hour meter 28 terminates accumulating time. The off delay timer 96 continues supplying the high voltage signal to the hour meter 26 and the inverter 42 for a predetermined duration after the OR gate 40 terminates the high voltage signal to the off delay timer 96. After the predetermined duration, the off delay timer 96 terminates the high voltage signal and supplies a low voltage signal to the hour meter 26 and the inverter 42. In response to receiving the low voltage signal from the off delay timer, the hour meter 26 terminates accumulating time and the inverter 42 inverts the low voltage signal to a high voltage signal which is supplied to the hour meter 28. In response to receiving the high voltage signal from the inverter 42, the hour meter 28 commences accumulating time. If another signal is received from the OR gate 40 before the predetermined duration has lapsed, the off delay timer 96 resets the predetermined duration and continues supplying the high voltage signal to the hour meter 26 and the inverter 42. Thus, in response to the high voltage signal from the OR gate 40, the off delay timer 96 supplies the high voltage signal to the hour meter 26 and the inverter 42 and maintains the high voltage signal to the hour meter 26 and the inverter 42 for a predetermined duration after termination of the high voltage signal from OR gate 40. Moreover, if the OR gate 40 supplies another high voltage signal before the predetermined duration expires, the off delay timer 96 resets the predetermined duration and continues supplying the high voltage signal to hour meter 26 and the inverter 42 for another predetermined duration. The hour meter 26 and the hour meter 28 may be mechanical or digital with a non-volatile memory and may be resettable or non-resettable.

Figure 3A:
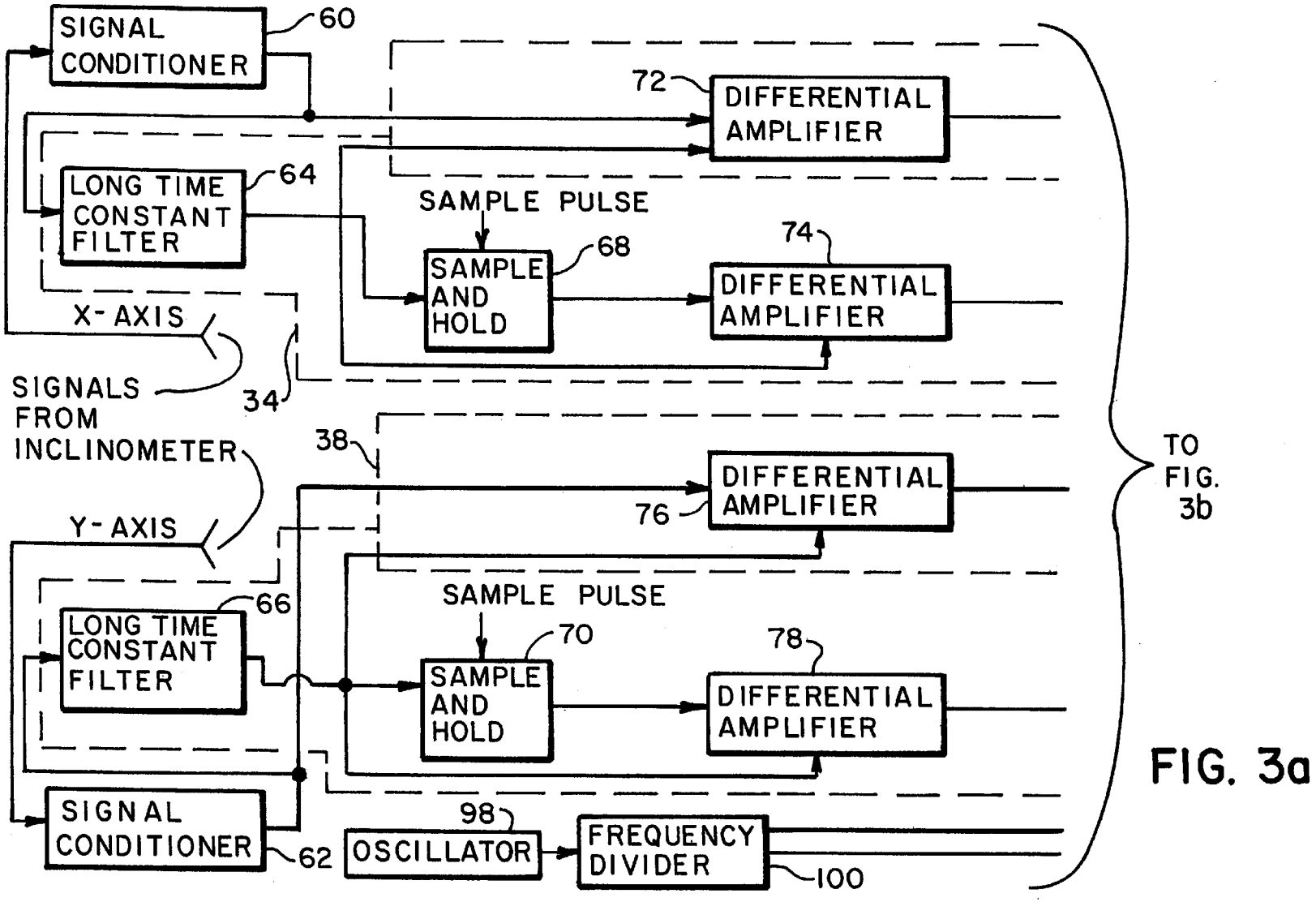
FIGS. 3*a*–3*b* are block diagrams of the internal circuitry of the utilization detector of FIG. 2.
Figure 3B:
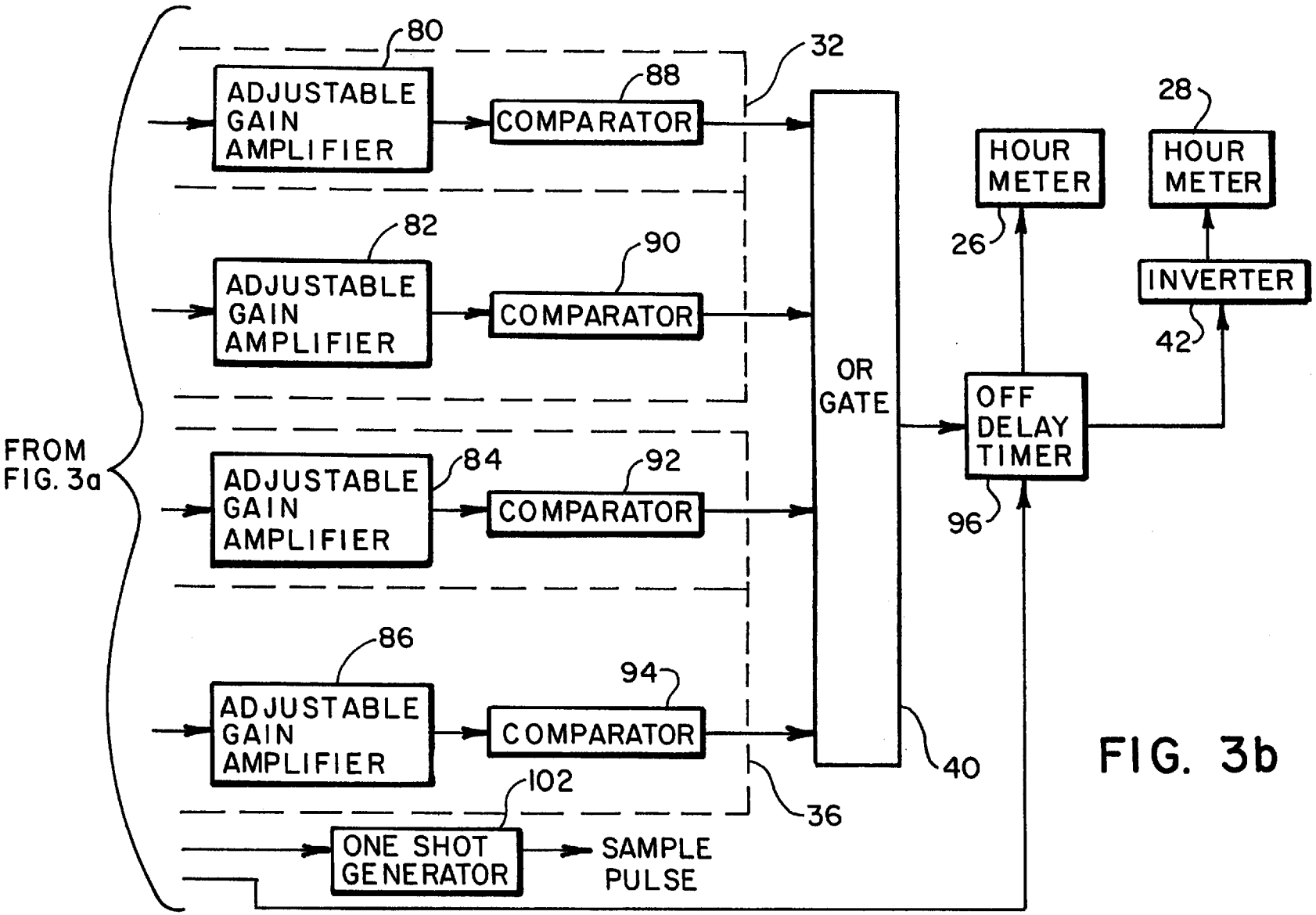

With reference to FIGS. 3*a*–3*b*, the X-axis slow motion detection circuitry 34 includes, in order, from the signal conditioner 60, a long time constant filter 64, a sample and hold circuit 68, a differential amplifier 74, an adjustable gain amplifier 82 and a comparator 90. The long time constant filter 64 heavily filters, i.e., low pass filters, any sudden changes in voltage (voltage spikes) output by the signal conditioner 60 and supplies a low pass filtered voltage signal to the sample and hold circuit 68 and the differential amplifier 74. At predetermined intervals, the sample and hold circuit 68 samples the low pass filtered voltage signal and supplies the sampled voltage signal to the differential amplifier 74. The differential amplifier 74 takes a difference between the sampled voltage signal and the low pass filtered voltage signal and supplies a difference voltage to the adjustable gain amplifier 82 which amplifies the difference voltage and supplies the amplified difference voltage to the comparator 90. The comparator 90 compares the amplified difference voltage to a preset trigger voltage and supplies a high voltage signal to the OR gate 40 if the amplified difference voltage exceeds the trigger voltage. If the amplified difference voltage is less than the trigger voltage, however, the comparator 90 supplies a low voltage signal to the OR gate 40.

It is at the comparator 90 that the analog voltage signal is translated to a digital voltage signal. Because the comparator 90 has a preset trigger voltage, increasing the gain of the adjustable gain amplifier 82 increases the sensitivity of the slow motion detection circuitry 34. Similarly, decreasing the gain of the adjustable gain amplifier 82 decreases the sensitivity of the slow motion detection circuitry 34.

In response to receiving a high voltage signal from the comparator 90, the OR gate 40 supplies a high voltage signal to the off delay timer 96. Upon receiving the high voltage signal from the OR gate 40, the off delay timer 96 resets an internal counter and supplies a high voltage signal to the hour meter 26 and the inverter 42. In response to receiving the high voltage signal from the off delay timer 96, the hour meter 26 commences accumulating time. Similarly, in response to receiving the high voltage signal from the off delay timer 96, the inverter 42 inverts the high voltage signal to a low voltage signal which is supplied to the hour meter 28. In response to receiving the low voltage signal from the inverter 42, the hour meter 28 terminates accumulating time. Thus, the hour meter 28 accumulates time only when the low voltage signal is supplied by the off delay timer 96 and the hour meter 26 accumulates time only when the high voltage signal is supplied by the off delay timer 96.

The X-axis sudden motion detection circuitry 32 includes, in order, from the signal conditioner 60, a differential amplifier 72, an adjustable gain amplifier 80 and a comparator 88. The voltage signal output by the signal conditioner 60 is supplied to the differential amplifier 72. The differential amplifier 72 also receives the low pass filtered voltage signal from the long time constant filter 64. The differential amplifier 72 takes a difference between the voltage signal supplied by the signal conditioner 60 and the low pass filtered voltage signal and supplies a difference voltage to the adjustable gain amplifier 80. The adjustable gain amplifier 80 amplifies the difference voltage and supplies the amplified difference voltage to the comparator 88 which contains a preset trigger voltage. If the amplified difference voltage is greater than the preset trigger voltage, the comparator 88 supplies a high voltage signal to the OR gate 40. If the amplified difference voltage is less than the preset trigger voltage, however, the comparator 88 supplies a low voltage signal to the OR gate 40.

It is at comparator 88 that the analog voltage signal is translated to a digital signal. Because comparator 88 has a preset trigger voltage, adjusting the gain of the adjustable gain amplifier 80 also adjusts the sensitivity of the sudden motion detection circuitry 32 to detect motion.

Upon receiving a high voltage signal from the comparator 88, the OR gate 40 supplies a high voltage signal to the off delay timer 96. In response to receiving the high voltage signal from the OR gate 40, the off delay timer 96 resets its internal counter and supplies a high voltage signal to the hour meter 26 and the inverter 42. In response to receiving the high voltage signal from the off delay timer 96, the hour meter 26 commences accumulating time. Similarly, in response to receiving the high voltage signal from the off delay timer 96, the inverter 42 inverts the high voltage signal to a low voltage signal which is supplied to the hour meter 28. In response to receiving the low voltage signal from the inverter 42, the hour meter 28 terminates accumulating time.

In order for the X-axis sudden motion detection circuitry 32 to detect motion, the voltage signal supplied by the inclinometer 30 must be compared to a reference voltage signal that changes in accordance with the position of the inclinometer relative to a horizontal plane which extends therethrough. This reference voltage signal is generated by the long time constant filter 64 and supplied to the differential amplifier 72 for comparison with the signal supplied by signal conditioner 60. Thus, the long time constant filter 64 supplies a reference voltage against which any voltage spikes indicative of sudden motion are compared. The differential amplifier 72 takes a difference between the signal supplied by the signal conditioner 60 and the low pass filtered voltage signal supplied by the long time constant filter 64 and supplies a voltage signal, e.g., voltage spike, indicative of sudden motion to the adjustable gain amplifier 80.

An oscillator 98 and a frequency divider 100 are utilized to set the counting frequency of the internal counter of the off delay timer 96. A one-shot generator 102, connected to receive an output of the frequency divider 100, is utilized to set the sample interval of the sample and hold circuit 68. The oscillator 98 supplies a first constant frequency signal to the frequency divider 100. The frequency divider 100 supplies a second constant frequency signal to the one-shot generator 102. Every cycle of the voltage signal supplied by frequency divider 100 causes the one-shot generator 102 to supply a sample pulse to the sample and hold circuit 68. Upon receiving the sample pulse, the sample and hold circuit 68 samples the voltage output of the long time constant filter 64 for the duration of the sample pulse. The frequency divider 100 also supplies a third constant frequency signal to the off delay timer 96 which, in the absence of a high voltage signal from the OR gate 40, counts a predetermined number of cycles before terminating the high voltage signal to the hour meter 26 and the inverter 42. However, if the off delay timer 96 receives a high voltage signal from the OR gate 40 while counting cycles from the frequency divider 100, the internal counters of the off delay timer 96 will reset and begin counting cycles all over again.

The Y-axis slow motion detection circuitry 36 is identical in structure and function to the X-axis slow motion detection circuitry 34, and includes a long time constant filter 66, a sample and hold circuit 70, a differential amplifier 78, an adjustable gain amplifier 86 and a comparator 94. The Y-axis sudden motion detection circuitry 38 is identical in structure and function to the X-axis sudden motion detection circuitry 32 and includes a differential amplifier 76, an adjustable gain amplifier 84 and a comparator 92.

Figure 4A:
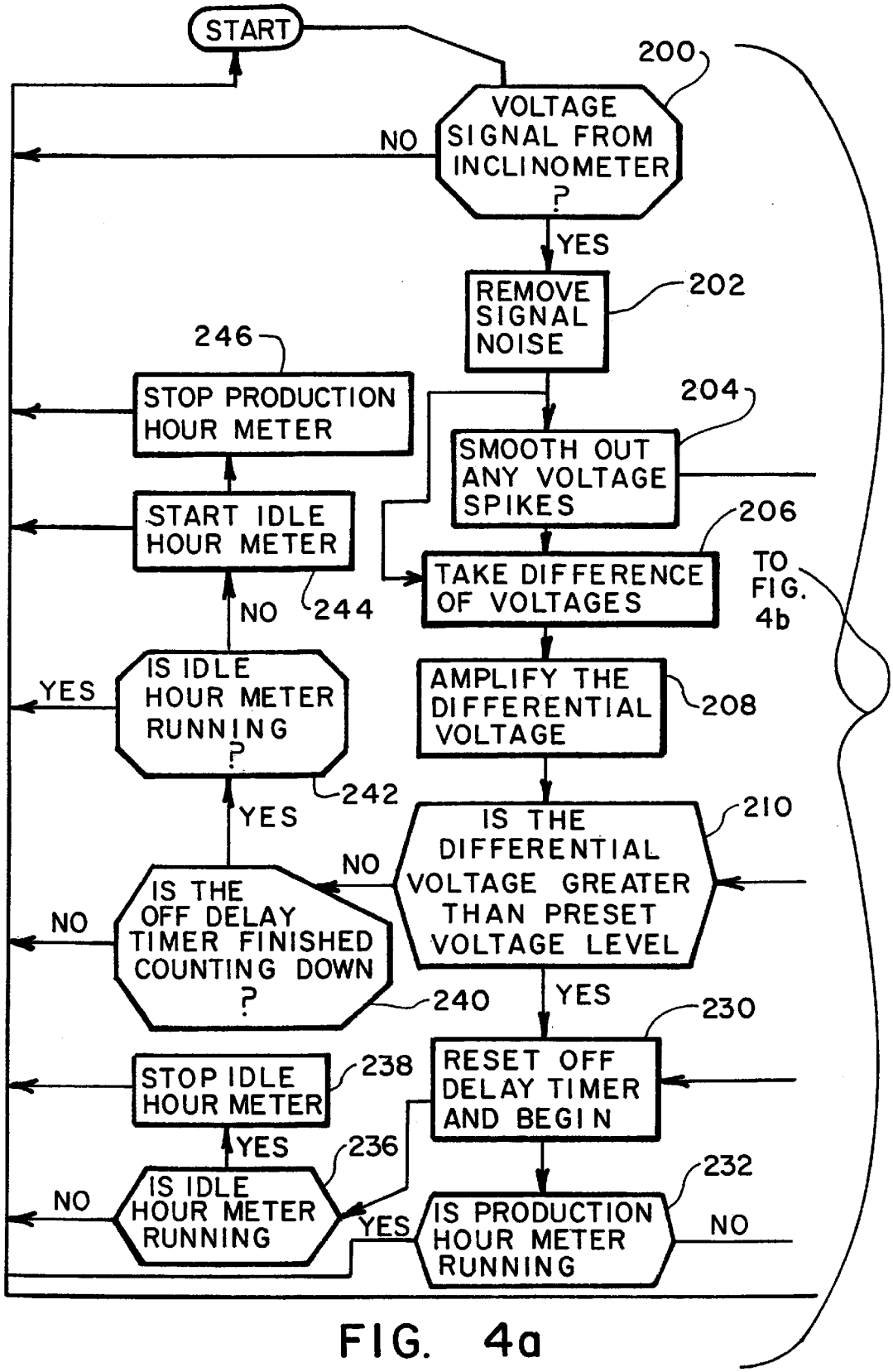
FIGS. 4*a*–4*b* are flowchart descriptions of the X-axis voltage signals passing through the motion detection circuitry of FIGS. 3*a*–3*b;*
Figure 4B:
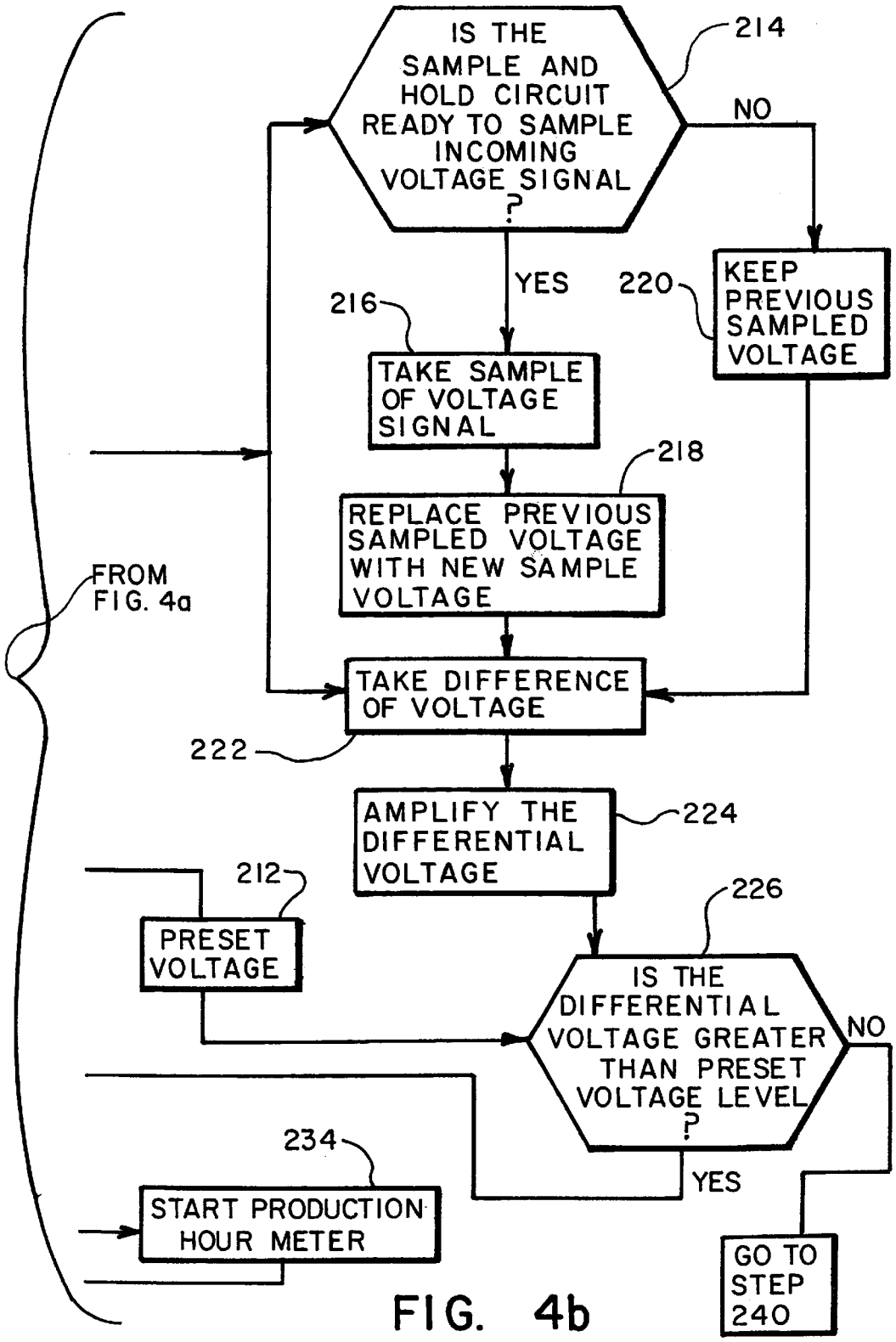

With reference to FIGS. 4*a*–4*b*, and with continuing reference to FIGS. 3*a*–3*b*, a flowchart description of the voltage signals passing through the X-axis motion detection circuitry of FIG. 3 includes step 200 wherein the utilization detector 22 is powered up and the inclinometer 30 supplies a voltage signal to the signal conditioner 60. At step 202 the signal conditioner 60 removes signal noise imposed on the voltage signal. The output of the signal conditioner 60 is supplied to the long time constant filter 64 and differential amplifier 72. With regard to the X-axis sudden motion detection circuitry 32, at step 204 the long time constant filter 64 low pass filters the voltage signal supplied by the signal conditioner 60 and supplies the low pass filtered voltage signal to the differential amplifier 72. At step 206 the differential amplifier 72 determines a difference between the output of the signal conditioner 60 and the output of the long time constant filter 64 and supplies the difference voltage to the adjustable gain amplifier 80. At step 208 the adjustable gain amplifier 80 amplifies the difference voltage and supplies the amplified difference voltage to the comparator 88. At step 210 the comparator 88 determines if the amplified difference voltage exceeds a preset voltage level established at step 212. If not, the comparator 88 supplies a low voltage to the OR gate 40. If, however, the output voltage signal of the adjustable gain amplifier 80 exceeds the preset voltage level, the comparator 88 supplies a high voltage to the OR gate 40. In response to receiving the high voltage from the comparator 88, the OR gate 40 supplies a high voltage signal to the off delay timer 96.

With regard to the X-axis slow motion detection circuitry 34, at step 204, the low pass filtered signal supplied by the signal conditioner 60 is also supplied to the sample and hold circuit 68 and differential amplifier 74. At step 214, it is determined if the sample and hold circuit 68 is ready to sample the voltage signal supplied by long time constant filter 64. If so, at step 216, the sample and hold circuit 68 samples the voltage signal supplied by the long time constant filter 64 and at step 218, the previously sampled voltage supplied by the long time constant filter 64 is replaced with the sampled voltage signal. If the sample and hold circuit 68 is not ready to sample the voltage signal supplied by the long time constant filter 64, at step 220, the previously sampled voltage of the long time constant filter 64 is retained. At step 222, the differential amplifier 74 determines a voltage difference between the output of the long time constant filter 64 and the output of the sample and hold circuit 68 and supplies the difference voltage to the adjustable gain amplifier 82. At step 224, the adjustable gain amplifier 82 amplifies the difference voltage supplied by differential amplifier 74 and supplies the amplified difference voltage to the comparator 90. At step 226, the comparator 90 determines if the amplified difference voltage exceeds a preset voltage level established at step 212. If not, the comparator 90 outputs a low voltage to the OR gate 40. If, however, the output voltage signal of adjustable gain amplifier 82 exceeds the preset voltage level, the comparator 90 supplies a high voltage to the OR gate 40. In response to receiving the high voltage from the comparator 90, the OR gate 40 supplies a high voltage signal to the off delay timer 96. It is to be appreciated that the preset voltage of comparator 90 and the preset voltage of comparator 88 are adjustable independent of each other.

At step 230, in response to receiving a high voltage signal from the OR gate 40, the off delay timer 96 resets its internal counter and sends out a high voltage signal to the hour meter 26 and the inverter 42. If the output of the OR gate 40 remains high, the internal counter is continuously reset so that the count of the internal counter does not change. If, however, the output of the OR gate 40 becomes a low voltage signal, the internal counter begins counting at a frequency established by the frequency divider 100. At step 236, it is determined if the hour meter 28, representative of idling hours, is running. If the hour meter 28 is running, the off delay timer 96 supplies the high voltage signal to the inverter 42 which inverts the high voltage signal to a low voltage signal and supplies the low voltage signal to the hour meter 28. In response to receiving the low voltage signal, the hour meter 28 terminates accumulating time at step 238. At step 232, it is determined if the hour meter 26, representative of production hours, is running. If not, at step 234, the off delay timer 96 supplies a high voltage signal that starts the hour meter 26 accumulating time.

If the voltage output by the adjustable gain amplifier 80 is not greater than the preset voltage level of the comparator 88 or if the voltage output by the adjustable gain amplifier 82 is not greater than the preset voltage level of comparator 90, at step 240, it is determined if the off delay timer 96 is finished counting the predetermined number of counts. If the off delay timer 96 is finished counting the predetermined number of counts, at step 242, it is determined if the hour meter 28, i.e., the idle hour meter, is running. If not, at step 244, the hour meter 28 commences accumulating time and at step 246, the hour meter 26 terminates accumulating time. If at step 242, it is determined that the hour meter 28 is running, the hour meter 28 is allowed to continue accumulating time and the hour meter 26 withholds accumulating time. If at step 242, it is determined that the hour meter 28 is not running, at step 244, the hour meter 28 (idle hour meter) commences accumulating time at step 246 and the hour meter 26 (production hour meter) terminates accumulating time.

In response to the output of the OR gate 40 changing from a high voltage signal to a low voltage signal, the internal counter of the off delay timer 96 counts a predetermined number of counts, whereafter the off delay timer 96 sends a low voltage signal to the hour meter 26 and the inverter 42. The inverter 42 converts the low voltage signal to a high voltage signal which is supplied to the hour meter 28. Upon receiving the high voltage signal, the hour meter 28 commences accumulating time. Upon receiving the low voltage signal from the off delay timer 96, the hour meter 26 terminates accumulating time. In this manner, the hour meter 26 operates when the OR gate 40 outputs a high voltage signal and for a predetermined interval after the output of the OR gate 40 changes from a high voltage signal to a low voltage signal. The hour meter 28 operates when the OR gate 40 outputs a low voltage signal and the off delay timer 96 has not received a high voltage signal from the OR gate 40 by the time the internal counter of the off delay timer 96 have finished counting a predetermined number of counts corresponding to a predetermined duration. When this occurs, the off delay timer 96 switches its output signal from a high voltage signal to a low voltage signal. In response to receiving the low voltage signal from the off delay timer 96, the inverter 42 inverts the low voltage signal to a high voltage signal which is supplied to the hour meter 28 which commences accumulating time.

Because the circuitry for motion detection along the Y-axis is identical to the circuitry for motion detection along the X-axis, the foregoing flowchart description of the X-axis voltage signals is equally applicable to the Y-axis voltage signals passing through the similar Y-axis circuitry.

The utilization detector 22 of the present invention operates by sensing voltage changes output by the inclinometer 30 in response to a change in the position of the inclinometer 30 relative to a plane, preferably a horizontal plane. An inclinometer suitable for use with the present invention is the AccuStar® II Dual Axis Clinometer produced by Lucas Automation & Control Engineering, Inc. of Hampton, Va. Since the inclinometer 30 is mounted securely to the material handling vehicle, any changes in the position of the material handling vehicle relative to the plane affect the voltage output of the inclinometer 30. In a preferred embodiment, operation of the inclinometer 30 is based on a liquid whose displacement changes the voltage output. Thus, any bumps, jolts, angular accelerations or linear accelerations will cause the liquid in the inclinometer 30 to shift position and change its output voltage. Consequently, the inclinometer 30 will pick up rotational movement of a hydraulic excavator or dragline as well as pick up the subtle dips and bumps that trucks, wheel loaders and bulldozers experience in a productive mode of operation. The slow motion detection circuitry and sudden motion detection circuitry monitor the change in voltage thereby avoiding the need for absolute reference points.

There are three types of motion that a material handling vehicle undergoes, namely, sudden motion, slow motion and no motion. Sudden motion occurs when the material handling vehicle experiences any sudden movement or jolt, such as a bump, dip or acceleration force, which results in a quick change in the voltage signal being sent out by the inclinometer 30. Slow motion occurs when the material handling vehicle is traveling or rotating very slowly such that a change in voltage coming from the inclinometer 30 occurs over a long period of time. No motion occurs when the material handling vehicle is at rest with its engine idling. The utilization detector 22 of the present invention is designed to detect all three types of motion.

Figure 5A:
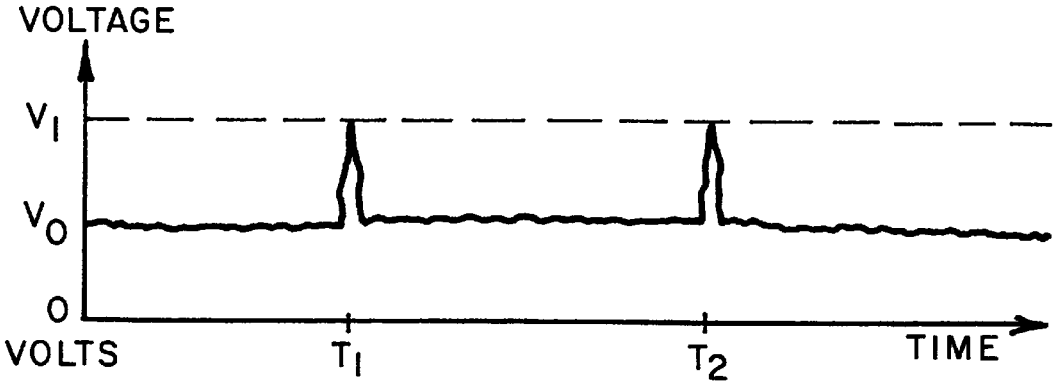
FIGS. 5*a*–5*d* are graphs showing voltage signals of a sudden change in movement as they pass through the sudden motion detection circuitry of FIGS. 3*a*–3*b;*
Figure 5B:
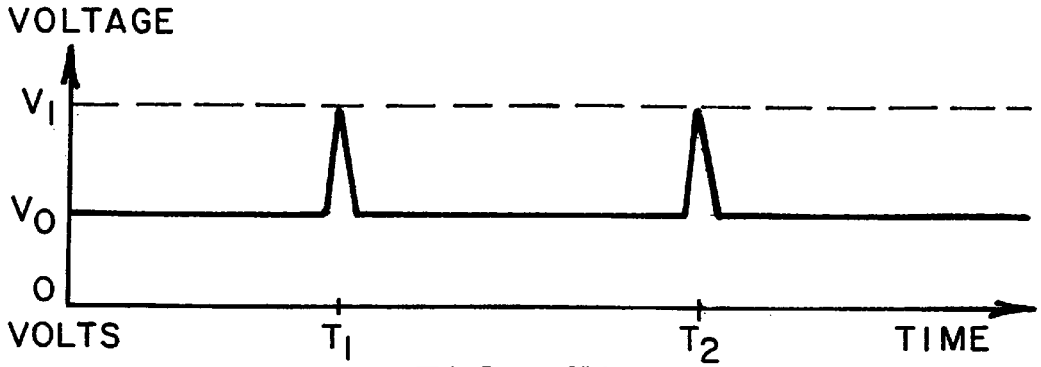

With reference to FIG. 5*a*, and with continuing reference to FIGS. 3*a*–3*b*, the steady state output of the inclinometer 30 in response to detecting little or no motion is represented as a relatively constant voltage signal at a level of $V_0$ and having electronic noise impressed thereon. About time $T_1$ the inclinometer 30 experiences a sudden motion occurrence. In response to the sudden motion occurrence, the inclinometer 30 outputs on one of its axes, e.g., the X-axis, a changing voltage signal having a peak amplitude at a level of $V_1$ and a duration corresponding to that of the sudden motion occurrence. With reference to FIG. 5*b*, the output of the inclinometer 30 is supplied to the signal conditioner 60 which removes the electronic noise and outputs a relatively constant voltage signal at a level of $V_0$ and, at about time $T_1$, outputs a spike-shaped changing voltage signal, absent electronic noise, having a peak amplitude at a level of $V_1$.

Figure 5C:
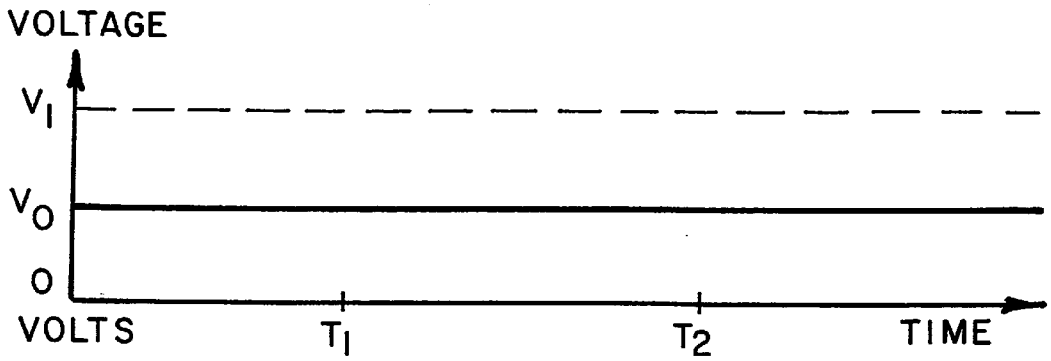
Figure 5D:
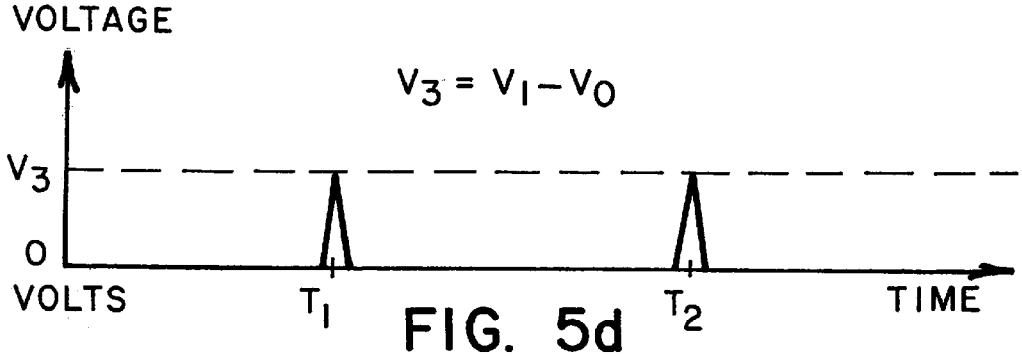

The output of the signal conditioner 60 is supplied to the long time constant filter 64 and differential amplifier 72. As shown in FIG. 5*c*, the long time constant filter 64 low pass filters the output of the signal conditioner 60 and supplies to the differential amplifier 72 a relatively constant voltage signal at a level of $V_0$, absent the changing voltage signal or spike at time $T_1$ shown in FIG. 5*b*. As shown in FIG. 5*d*, the differential amplifier 72 outputs a difference voltage signal at time $T_1$ having a peak amplitude at a level of $V_3$ which is the difference between the voltage signal at the level of $V_0$ output by the long time constant filter 64 and the voltage signal at the level of $V_1$ output by the signal conditioner 60. The difference voltage signal $V_3$ is supplied to the adjustable gain amplifier 80 which amplifies the difference voltage signal $V_3$ and supplies this amplified signal to comparator 88. Comparator 88 contains a preset trigger voltage which, if exceeded by this amplified signal, will cause comparator 88 to supply a high voltage signal to the OR gate 40 which in turn supplies a high voltage signal to the off delay timer 96. Upon receiving the high voltage signal from the OR gate 40, the off delay timer 96 resets its internal counters and supplies a high voltage signal to the hour meter 26 to commence the accumulation of time and to the inverter 42. In response to receiving the high voltage signal from the off delay timer 96, the inverter 42 inverts the high voltage signal to a low voltage signal and sends the low voltage signal to the hour meter 28. Upon receiving the low voltage signal from the inverter 42, the hour meter 28 terminates accumulating time. If the off delay timer 96 does not receive a high voltage signal from the OR gate 40 before it finishes counting down the predetermined numbered counts, the off delay timer 96 supplies a low voltage signal to the hour meter 26 and the inverter 42. When the inverter 42 receives the low voltage signal from the off delay timer 96, it inverts the low voltage signal to a high voltage signal and sends the high voltage signal to the hour meter 28. In response to receiving the high voltage signal from the inverter 42, the hour meter 28 commences accumulating time.

The relatively constant voltage signal at the level of $V_0$, shown in FIG. 5*c*, output by the long time constant filter 64, is also supplied to the sample and hold circuit 68 and the differential amplifier 74. Since the relatively constant voltage signal at a level of $V_0$ output by the long time constant filter 64 and the level of the voltage signal output by the sample and hold circuit 68 are nearly identical, the output of the differential amplifier 74 will be near zero volts. Consequently, the comparator 90 will not be triggered in spite of any voltage amplification by the adjustable gain amplifier 82. Sudden motion occurrences, however, will be detected by the sudden motion detection circuitry 32 and not by the slow motion detection circuitry 34.

At about time $T_2$, the inclinometer 30 experiences another sudden motion occurrence and outputs on one of its axes, e.g., the X-axis, a changing voltage signal having a peak amplitude at a level of $V_1$ at a duration that corresponds to the extent of the sudden motion occurrence. This changing voltage signal about time $T_2$ is treated by the signal conditioner 60, the long time constant filter 64, the differential amplifier 72, the adjustable gain amplifier 80, the comparator 88 and the OR gate 40 in the same manner as the changing voltage signal occurring about time $T_1$. In response to receiving the high voltage signal from the OR gate 40 at about time $T_2$, the off delay timer 96 resets its internal counters and begins counting down a predetermined number of counts corresponding to the predetermined duration while supplying the high voltage signal to the hour meter 26 and the inverter 42. If the voltage signal at time $T_2$ is received by the off delay timer 96 before the internal counters of the off delay timer 96 count the predetermined number of counts from the voltage signal received at time $T_1$, the off delay timer 96 maintains the high voltage signal to the hour meter 26 and the inverter 42. Accordingly, the hour meter 26 and the inverter 42 experience no interruption in the receipt of the high voltage signal from the off delay timer 96 between times $T_1$ and $T_2$. Accordingly, the hour meter 26 continues to accumulate or record time during periods when the equipment is being productively utilized but not in motion between times $T_1$ and $T_2$, e.g., waiting for a bucket dump or waiting for another vehicle to pass. Moreover, the hour meter 28 will not accumulate time between times $T_1$ and $T_2$ since the inverter 42 inverts the high voltage signal from the off delay timer 96 to a low voltage signal. The hour meter 28 will not accumulate time as long as it receives this low voltage signal from the inverter 42.

If, however, the internal counters of the off delay timer 96 count the predetermined number of counts after receiving the high voltage signal from the OR gate 40 at time $T_1$, the off delay timer 96 terminates the high voltage signal to the hour meter 26 and the inverter 42. In response to receiving the low voltage signal from the off delay timer 96, the hour meter 26 terminates accumulating time. When the inverter 42 receives the low voltage signal from the off delay timer 96, it inverts the low voltage signal to a high voltage signal and supplies the high voltage signal to the hour meter 28. In response to receiving the high voltage signal from the inverter 42, the hour meter 28 commences accumulating time. If the off delay timer 96 terminates the high voltage signal to the hour meter 26 and the inverter 42, upon receipt of the voltage signal at time $T_2$ the internal counters of the off delay timer 96 are reset and the off delay timer 96 again outputs a high voltage signal to the hour meter 26 and the inverter 42. In response to the high voltage signal from the off delay timer 96, the hour meter 26 commences accumulating time and the inverter 42 inverts the high voltage signal to a low voltage signal which is supplied to the hour meter 28. In response to receiving the low voltage signal, the hour meter 28 terminates accumulating time.

Figure 6A:
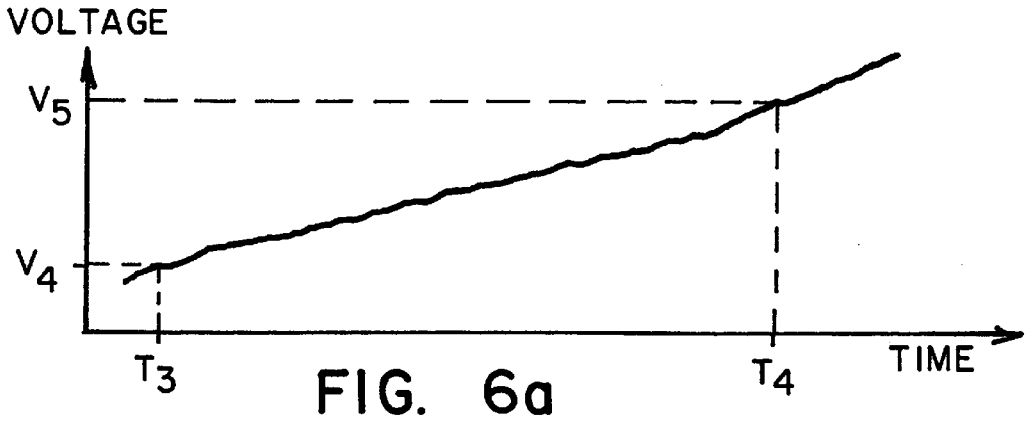
FIGS. 6*a* –6*e* are graphs showing voltage signals of a slow change in movement as they pass through the slow motion detection circuitry of FIGS. 3*a*–3*b*.
Figure 6B:
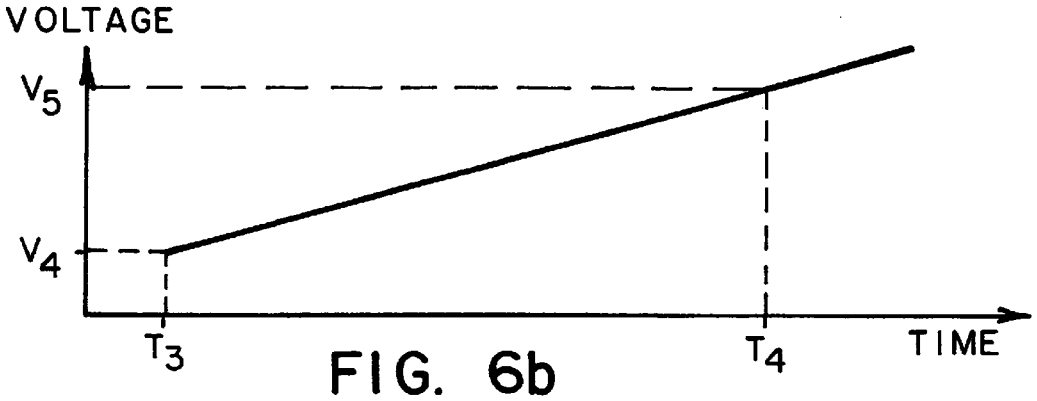

With reference to FIG. 6*a*, and with continuing reference to FIGS. 3*a*–3*b*, in response to undergoing a slow motion occurrence the inclinometer 30 supplies on one of its axes, e.g., the X-axis, a voltage signal that slowly increases from a level of $V_4$ to a level of $V_5$ over an interval of time ($T_4$–$T_3$). With reference to FIG. 6*b*, the slowly increasing level of the voltage signal of FIG. 6*a* is supplied to the signal conditioner 60 which removes electronic noise impressed thereon and outputs a slowly increasing level of the voltage signal absent the electronic noise.

Figure 6C:
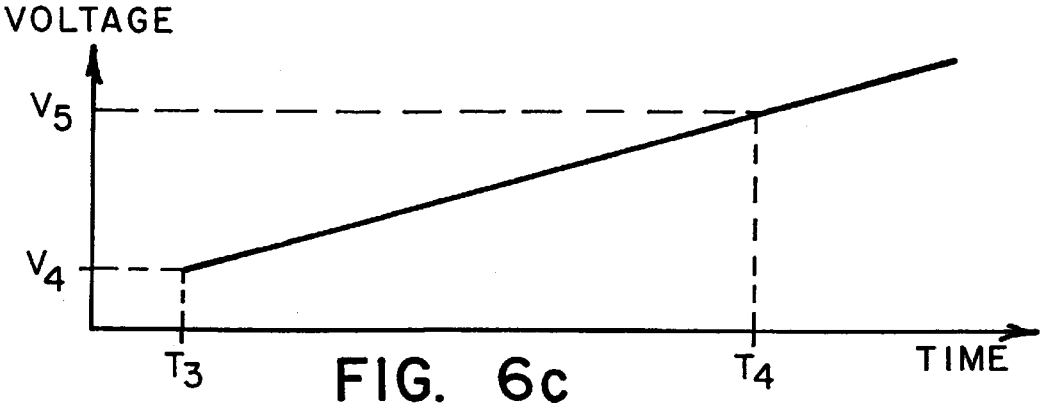

The output of the signal conditioner 60 is supplied to the differential amplifier 72 and the long time constant filter 64 which low pass filters the output of the signal conditioner 60 and supplies, as shown in FIG. 6*c*, a slowly increasing level of voltage signal to the differential amplifier 72. Because the long time constant filter 64 is a low pass filter, the slowly increasing level of the voltage signal output by the signal conditioner 60 passes through the long time constant filter 64 substantially unchanged. The differential amplifier 72 outputs a voltage signal that has a level that is the difference between the level of the output voltage signal of the long time constant filter 64 and the level of the output voltage signal of the signal conditioner 60. Since the level of the output voltage signals of the long time constant filter 64 and the signal conditioner 60 are nearly identical, the level of the difference voltage signal output by the differential amplifier 72 will be near zero volts. Consequently, comparator 88 will not be triggered in spite of any amplification of the level of the difference voltage signal output by the adjustable gain amplifier 80.

Figure 6D:
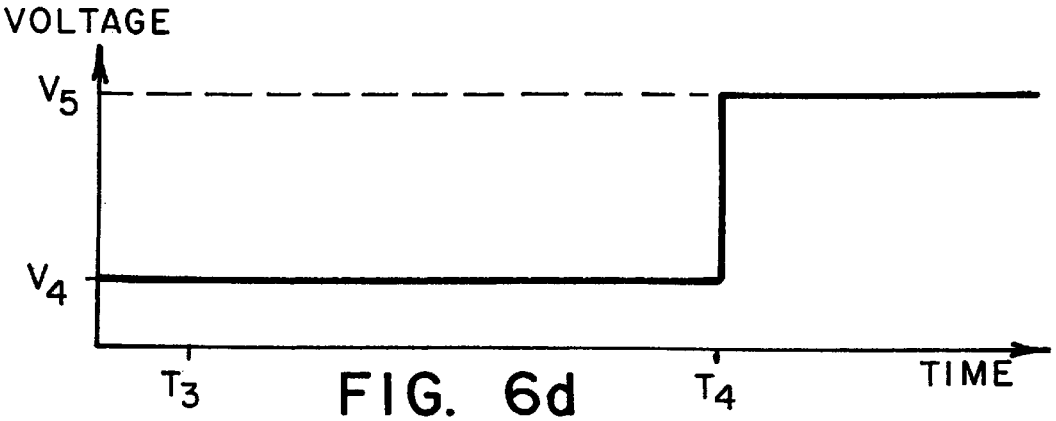

With reference to FIG. 6*d*, the level of the voltage signal output by the long time constant filter 64 is also supplied to the sample and hold circuit 68 and the differential amplifier 74. The sample and hold circuit 68 samples the level of the voltage signal output by the long time constant filter 64 at time $T_3$ and time $T_4$ and supplies the sampled level of the voltage signal output to differential amplifier 74.

Figure 6E:
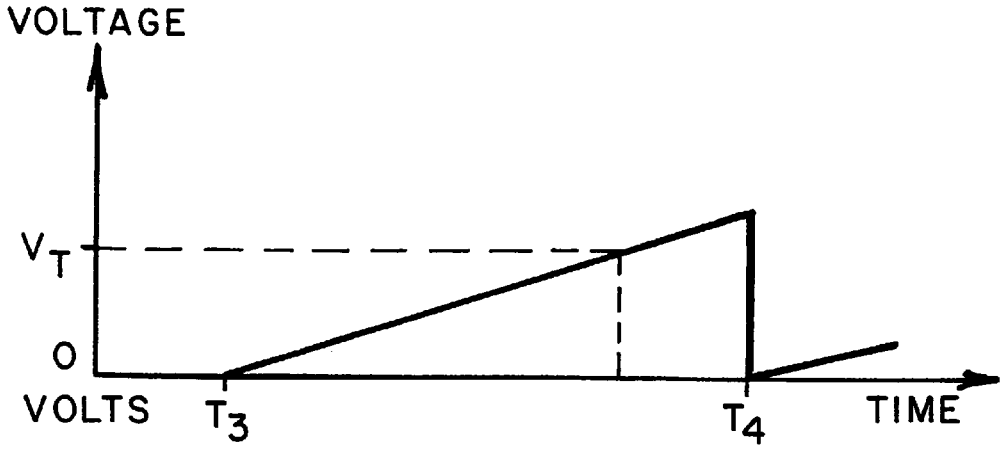

With reference to FIG. 6*e*, the differential amplifier 74 takes a difference between the sampled level of the voltage signal output supplied by the sample and hold circuit 68 and the level of the voltage signal output supplied by the long time constant filter 64 and supplies the difference in the level of the voltage signal therebetween to the adjustable gain amplifier 82. The adjustable gain amplifier 82 amplifies the level of the difference voltage signal and supplies this amplified level of the difference voltage signal to the comparator 90. Between time $T_3$ and time $T_4$, the level of the output voltage signal from the adjustable gain amplifier 82 increases to the level of the trigger voltage signal $V_T$ of the comparator 90. When the level of the voltage signal output by the adjustable gain amplifier 82 exceeds the level of the trigger voltage signal $V_T$, the comparator 90 supplies a high voltage signal to the OR gate 40 which, in response, provides a high voltage signal to the off delay timer 96. In response to receiving the high voltage signal from the OR gate 40, the off delay timer 96 resets its internal counters and supplies a high voltage signal to the hour meter 26 and the inverter 42. Upon receiving the high voltage signal from the inverter 42, the hour meter 26 commences accumulating time. Upon receiving the high voltage signal from the off delay timer 96, the inverter 42 supplies to the hour meter 28 a low voltage signal which causes the hour meter 28 to terminate accumulating time.

Figure 7A:
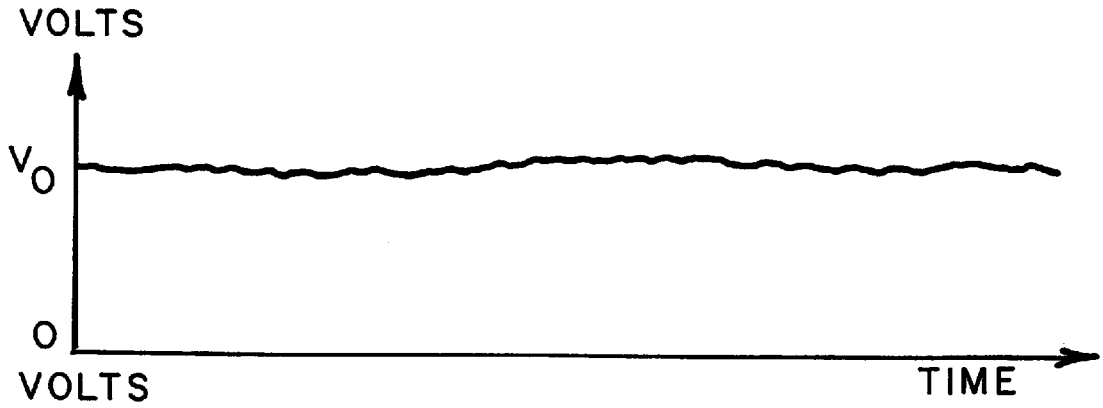
FIGS. 7*a*–7*b* are graphs showing voltage signals from a material handling vehicle at rest with its engine idling and passing through a signal conditioner.

With reference to FIG. 7*a*, a constant voltage signal at a level of $V_0$ generated by the dual axis electronic inclinometer 30 illustrates a material handling vehicle at rest with no motion occurring other than vibration of the engine 18 at idle. If the engine 18 is vibrating in such a manner as to be detected by the utilization detector 22, then the gain of the adjustable gain amplifiers 80 and 82 can be adjusted so that the level of the voltage signals output by the adjustable gain amplifiers 80 and 82 are insufficient to trigger the comparators 88 and 90.

Figure 7B:
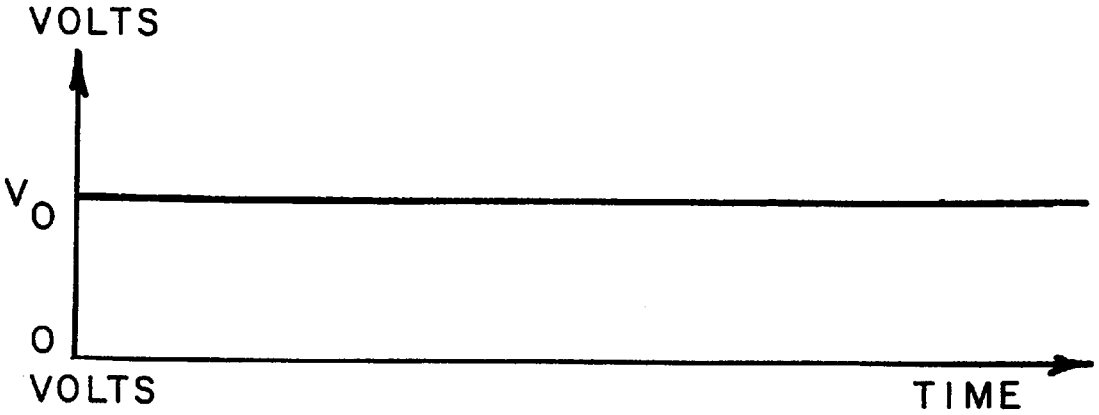

With reference to FIG. 7*b*, the voltage signal output by the dual axis electronic inclinometer 30 is supplied to the signal conditioner 60 which removes electronic noise impressed thereon and supplies a substantially noise free voltage signal at a level of $V_0$ to the differential amplifier 72 and the long time constant filter 64. The long time constant filter 64 supplies its output voltage signal to the differential amplifiers 72 and 74 and the sample and hold circuit 68. Since there is no difference in the level of the voltage signal between the output of the signal conditioner 60, the output of the long time constant filter 64 and the output of the sample and hold circuit 68, the differential amplifiers 72 and 74 will both output a differential voltage signal having a level that is nearly zero volts. Consequently, the comparators 88 and 90 will not be triggered in spite of any voltage amplification by the adjustable gain amplifiers 80 and 82, respectively. Thus, the OR gate 40 will receive low voltage signals from the comparators 88 and 90 and will provide a low voltage signal to the off delay timer 96.

The number of counts the off delay timer 96 counts before terminating the high voltage signal to the hour meter 26 and the inverter 42 can be adjusted to increase or decrease the duration the off delay timer outputs the high voltage signal to the hour meter 26 and the inverter 42 after termination of the high voltage output by OR gate 40.

It has been observed that most vehicles upon which the equipment utilization detector of the present invention is intended to be utilized predominantly undergo sudden motion occurrences. For these vehicles, certain components of the X-axis slow motion detection circuitry 34 and the Y-axis slow motion detection circuitry 36 can be omitted without affecting the performance of the equipment utilization detector. The components that can be omitted include sample and hold circuits 68 and 70, differential amplifiers 74 and 78, adjustable gain amplifiers 82 and 86 and comparators 90 and 94. Importantly, however, the long time constant filters 64 and 66 are retained in order to supply the reference voltage level signal to differential amplifiers 72 and 76, respectively, against which the changing levels of voltage signals supplied by signal conditioners 60 and 62 are compared. Moreover, in the absence of the sample and hold circuits 68 and 70, the one-shot generator 102 providing the sample pulse to sample and hold circuits 68 and 70 can also be omitted.

Alternatively, in vehicles where slow motion occurrences predominate, such as a dragline, the circuitry associated with the X-axis sudden motion detection circuitry 32 and the Y-axis sudden motion detection circuitry 38 can be omitted. Specifically, differential amplifiers 72 and 76, adjustable gain amplifiers 80 and 84 and comparators 88 and 92 can be omitted.

The utilization detector 22 includes the hour meter 26 for accumulating time the material handling vehicle is in production and the hour meter 28 for accumulating time the material handling vehicle is at rest with the engine idling. Together, these two hour meters account for the utilization of the material handling vehicle. The sum of idle hours plus production hours equals the total engine hours. Consequently, a material handling vehicle which has an engine hour meter can choose to have only the hour meter 26 for accumulating production hours. The idling hours can be determined by subtracting the production hours from the engine hours. Similarly, a material handling vehicle which has an engine hour meter can choose to have only the hour meter 28 for accumulating idling hours. The production hours can be determined by subtracting the idling hours from the engine hours.

In a preferred embodiment, the above-described utilization detector is self-contained, environmentally secured and operates independent of the equipment's moving parts or fluids, such as the transmission, final drives, tires, engine, oil flow or fuel flow. Because the utilization detector is self-contained and environmentally secured, it is not subject to the potentially harsh effects of the environment in which the material handling vehicle is utilized thereby resulting in greater durability and reliability. Moreover, the utilization detector is easily installable on any piece of equipment where motion is a measure of utilization, i.e., being in a state of production. To this end, it is not necessary to drill holes in the transmission, final drives or engine—the unit is simply attached to a convenient location on the equipment and attached to the vehicle battery.

Based on the foregoing, it should be appreciated that the utilization detector of the present invention provides an effective way to lower costs and increase production of material handling vehicles by allowing engine hours to be divided into production hours and idling hours which are used to indicate the material handling vehicle's degree of utilization. Specifically, the utilization detector 22 monitors the time the material handling vehicle is in motion as well as the time that the material handling vehicle is at rest with the engine idling. It accumulates these times on two separate hour meters. Measuring the time the vehicle is in motion is the same as measuring its state of production, i.e., time over which production is taking place, versus actual production, i.e., weight or volume of material moved in a certain period of time.

Benefits of the utilization detector of the present invention include: reduced maintenance costs, since the changing of fluids (excluding engine oil), filters, greasing and the like, can be scheduled based on utilization hours rather than engine hours; improved predictability in forecasting component wear, and consequently when to replace a component, based on the actual utilization of the equipment; lower repair costs due to replacement of components based on the actual utilization of the vehicle compared to the engine hours; improved accuracy in comparing the economic lives of vehicles by removing the idle time of the vehicle from consideration; improved accuracy in determining the hourly costs of the vehicle by excluding idle time from the consideration of hourly costs thereby attributing costs to productive use of the vehicle rather than engine use; improving the determination of how effectively the vehicle is being utilized by comparing the accumulated production hours to the accumulated engine hours—the closer the production hours are to the engine hours, the more efficiently the vehicle is being utilized; providing buyers and sellers of used vehicles with a more accurate understanding of how the vehicle was utilized such that the selling price of the vehicle can be based on the vehicle as a whole and not simply on the utilization of the engine; and providing the ability to implement an effective incentive program based on equipment utilization which can be applied to material handling vehicles and which directly measures the operator's productive interaction with the equipment.

The invention has been described with reference to the preferred embodiment. Obvious modifications and alterations will occur to others upon reading and understanding the preceding description. For example, the electronic inclinometer can be replaced with an ultrasonic sensor which picks up the change in distance between the material handling vehicle and the ground. Another example would be the use of a proximity switch, placed near a rotating gear in the final drive or transmission, which could indicate a state of linear movement. Another example would be to use radar or a global positioning satellite (GPS) system to determine a state of motion. Still another example would be to replace some of the circuitry with a software-driven digital computer that performs the functions of the replaced circuitry. It is intended that the invention be construed as including all such modifications and alterations insofar as they come within the scope of the appended claims or the equivalents thereof.

We claim:

1. A utilization detector attachable to equipment for determining the utilization of the equipment, the utilization detector comprising:

a motion detector which generates an output signal upon a change of its position relative to a plane;

a motion analysis circuit responsive to the output signal from the motion detector and generating at least one of (i) a sudden motion output signal in response to a sudden motion detected by the motion detector, and (ii) a slow motion output signal in response to a slow motion detected by the motion detector; and a time accumulator responsive to at least one of the slow motion output signal and the sudden motion output signal, wherein:

the time accumulator records at least one of a production interval and a idling interval;

the production interval corresponds to a duration that the motion analysis circuit generates the at least one of the slow motion output signal and the sudden motion output signal; and the idling interval corresponds to a duration that the motion analysis circuit withholds the slow motion output signal and the sudden motion output signal.

2. The utilization detector as set forth in claim 1 wherein the motion analysis circuit includes:

a sudden motion analysis circuit which generates the sudden motion output signal; and a slow motion analysis circuit which generates the slow motion output signal.

3. The utilization detector as set forth in claim 1 wherein the motion analysis circuit includes at least one of:

an X-axis sudden motion analysis circuit;

an X-axis slow motion analysis circuit;

a Y-axis sudden motion analysis circuit; and a Y-axis slow motion analysis circuit.

4. The utilization detector as set forth in claim 1 further including an off delay timer connected between the motion analysis circuit and the time accumulator, wherein:

the off delay timer supplies to the time accumulator an output signal which commences recording of the production interval in response to the generation of the at least one of the sudden motion output signal and the slow motion output signal;

the off delay timer causes the time accumulator to record the production interval for a predetermined duration after the termination of the at least one of the sudden motion output signal and the slow motion output signal; and in response to termination of the output signal by the off delay timer, the time accumulator at least one of terminates recording the production interval and commences recording the idling interval.

5. The utilization detector as set forth in claim 4 further including an OR gate which receives the at least one of the sudden motion output signal and the slow motion output signal and supplies an output signal to the off delay timer in response to receiving the at least one of the sudden motion output signal and the slow motion output signal.

6. The utilization detector as set forth in claim 5 further including a signal conditioner which receives the output signal from the motion detector, removes electronic noise impressed on the output signal from the motion detector and supplies an output signal to the motion analysis circuit.

7. The utilization detector as set forth in claim 4 wherein the predetermined duration is adjustable.

8. The utilization detector as set forth in claim 1 wherein the motion detector generates an output signal related to its steady state position relative to the plane.

9. A method of determining utilization of a vehicle, the method comprising the steps of:

determining an extent of at least one of a sudden change and a slow change in the position of the vehicle;

providing an electrical signal related to the extent;

comparing the electrical signal to corresponding sudden change and slow change reference values;

accumulating a production interval corresponding to the duration the electrical signal is one of greater than and less than at least one of the corresponding reference values; and accumulating an idling interval corresponding to the duration the electrical signal is the other of greater than and less than the corresponding reference values.

10. The method as set forth in claim 9 further including the step of extending the duration the production interval is accumulated for a predetermined period after the electrical signal one of (i) changes between greater than and less than the at least one of the corresponding reference values and (ii) changes between less than and greater than the at least one of the corresponding reference values.

11. The method as set forth in claim 10 wherein at least one of the duration of the predetermined period, the sudden change reference value and the slow change reference value is adjustable.

12. An equipment utilization detector which detects the utilization of equipment, the utilization detector comprising:

(a) a motion detector which detects motion in at least one of an X-axis and a Y-axis with respect to the equipment and which generates an output signal corresponding to the detected motion;

(b) a signal conditioner which receives the output signal from the motion detector and removes electronic noise therefrom and which generates an output signal;

(c) at least one of:

(i) a sudden motion detector which receives the output signal from the signal conditioner and detects therefrom when the equipment undergoes sudden motion and which generates an output signal which is a function of the sudden motion; and (ii) a slow motion detector which receives the output signal from the signal conditioner and detects therefrom when the equipment undergoes gradual motion and which generates an output signal which is a function of the gradual motion;

(d) an OR gate connected to receive at least one of the sudden motion detector output signal and the slow motion detector output signal and generate an output signal in response to receiving the at least one of the sudden motion detector output signal and the slow motion detector output signal; and (e) a time accumulator which accumulates production time in response to the output signal from the OR gate and which accumulates idling time in response to the absence of the output signal from the OR gate.

13. The equipment utilization detector as set forth in claim 12 wherein the slow motion detector includes:

a long time constant filter which receives the output signal from the signal conditioner and filters voltage spikes on the output signal from the signal conditioner and which generates a filtered voltage signal;

a sample and hold circuit which receives and samples the filtered voltage signal and which generates a sampled voltage signal;

a differential amplifier which receives the sampled voltage signal and the filtered voltage signal and which outputs a difference voltage that is the difference between the sampled voltage signal and the filtered voltage signal;

an adjustable gain amplifier which receives and amplifies the difference voltage and which generates an amplified difference voltage; and a comparator which receives the amplified difference voltage and which compares the amplified difference voltage to a trigger voltage and which generates a high signal to the OR gate in response to the amplified difference voltage exceeding the trigger voltage.

14. The equipment utilization detector as set forth in claim 13 further including:

an oscillator that generates a first constant frequency signal;

a frequency divider which receives the first constant frequency signal and generates a second constant frequency signal; and a one shot generator which receives the second constant frequency signal and generates pulses for the sample and hold circuit at the frequency of the second constant frequency signal.

15. The equipment utilization detector as set forth in claim 14 further including an off delay timer connected to receive the output signal from the OR gate and to supply an output signal to the time accumulator, wherein:

in response to receiving the output signal from the OR gate, the off delay timer supplies its output signal to the time accumulator;

the frequency divider supplies a third constant frequency signal to the off delay timer; and the off delay timer terminates its output signal to the time accumulator in response to counting a predetermined number of cycles of the third constant frequency signal.

16. The equipment utilization detector as set forth in claim 13 wherein the trigger voltage is adjustable.

17. The equipment utilization detector as set forth in claim 12 wherein the sudden motion detector includes:

a long time constant filter which receives the output signal from the signal conditioner and filters voltage spikes on the output signal from the signal conditioner and which generates a filtered voltage signal;

a differential amplifier which receives the filtered voltage signal and the output signal from the signal conditioner and which outputs a difference voltage that is the difference between the filtered voltage signal and the output signal from the signal conditioner;

an adjustable gain amplifier which receives and amplifies the difference voltage and which outputs an amplified difference voltage; and a comparator which receives and compares the amplified difference voltage to a trigger voltage and generates a high signal to the OR gate in response to the amplified difference voltage exceeding the trigger voltage.

18. The equipment utilization detector as set forth in claim 17 further including:

an off delay timer connected to receive the output signal from the OR gate and to supply an output signal to the time accumulator, wherein:

in response to receiving the output signal from the OR gate, the off delay timer supplies its output signal to the time accumulator;

the off delay timer has a clock input connected to receive a constant frequency signal; and in response to the OR gate terminating its output signal to the off delay timer, the off delay timer counts a predetermined number of cycles of the constant frequency signal and terminates its output to the time accumulator.

19. The equipment utilization detector as set forth in claim 17 wherein the trigger voltage is adjustable.

20. The equipment utilization detector as set forth in claim 12 further including an off delay timer connected to receive the output signal from the OR gate and to supply an output signal to the time accumulator, wherein:

in response to receiving the output signal from the OR gate, the off delay timer supplies its output signal to the time accumulator;

the time accumulator accumulates the production time in response to the output signal from the off delay timer;

the off delay timer supplies its output signal to the time accumulator for a predetermined interval after the OR gate terminates its output signal to the off delay timer; and the time accumulator accumulates the idling time in response to the absence of the output signal from the off delay timer.

* * * * *